US006357621B1

(12) United States Patent
Guindulain Vidondo

(10) Patent No.: US 6,357,621 B1
(45) Date of Patent: Mar. 19, 2002

(54) DISTRIBUTOR

(75) Inventor: Félix Guindulain Vidondo, Peralta (ES)

(73) Assignee: Jofemar, S.A., Peralta (ES)

( * ) Notice: Subject to any disclaimer, the term of this patent is extended or adjusted under 35 U.S.C. 154(b) by 0 days.

(21) Appl. No.: 09/446,273

(22) PCT Filed: Mar. 25, 1999

(86) PCT No.: PCT/ES99/00078

§ 371 Date: Dec. 17, 1999

§ 102(e) Date: Dec. 17, 1999

(87) PCT Pub. No.: WO99/56256

PCT Pub. Date: Nov. 4, 1999

(30) Foreign Application Priority Data

Apr. 23, 1998 (ES) ..... 9800864
Nov. 27, 1998 (ES) ..... AC9802496

(51) Int. Cl.[7] ..... G07F 11/00
(52) U.S. Cl. ..... 221/85; 221/124; 221/133
(58) Field of Search ..... 221/76, 77, 79, 221/84, 85, 87, 123, 124, 130, 133, 121, 119, 150 R

(56) References Cited

U.S. PATENT DOCUMENTS 2,923,392 A * 2/1960 Gabrielsen ..... 221/85 X
2,963,883 A * 12/1960 Teesdale ..... 221/150 R X
4,108,333 A * 8/1978 Falk et al. ..... 221/85 X
5,048,719 A 9/1991 Empl et al.

* cited by examiner

*Primary Examiner*—David H. Bollinger
(74) *Attorney, Agent, or Firm*—Klauber & Jackson

(57) ABSTRACT

Distributor machine of the type comprising a cooling unit for preserving cooled food products until they are consumed, the distributor comprising rectangular trays (2) which are arranged horizontally and which rotate independently from each other with respect to an axis (10) relative to a front apex; said trays (2) are provided with longitudinal compartments (3) of which the basis has a central longitudinal opening with respect to which are arranged rotary chains between two horizontal axis (5) operated by the corresponding motor (6) in order to displace the selected products (15) towards a reception tray (7) and convey them to the mouth (17) for collection by the user, the tray (7) being in a transversal position with respect to the feed direction of the products when ejected from the corresponding compartment (3).

20 Claims, 8 Drawing Sheets

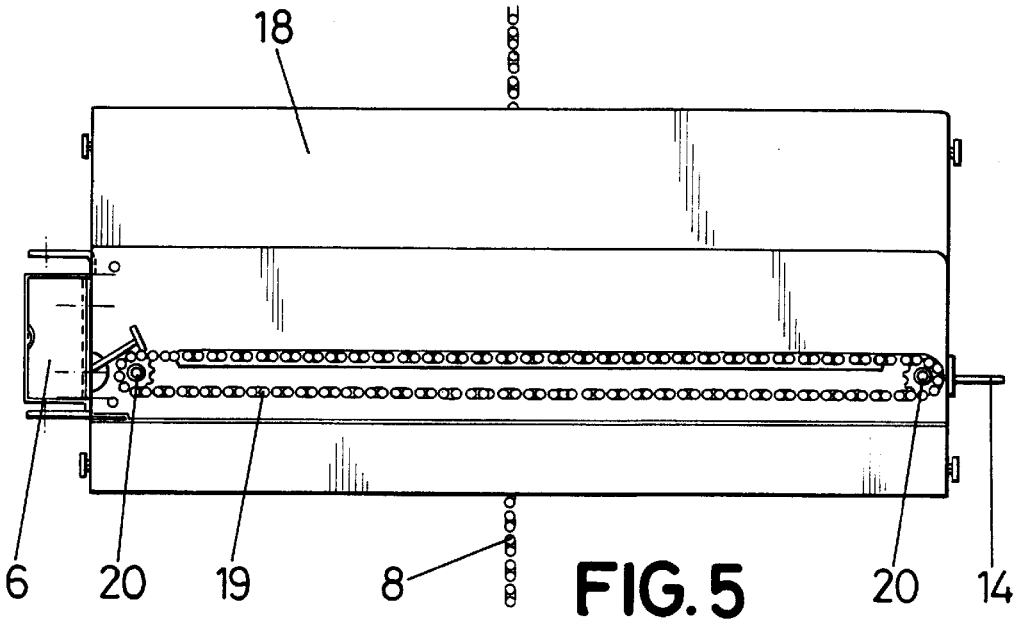
FIG. 5
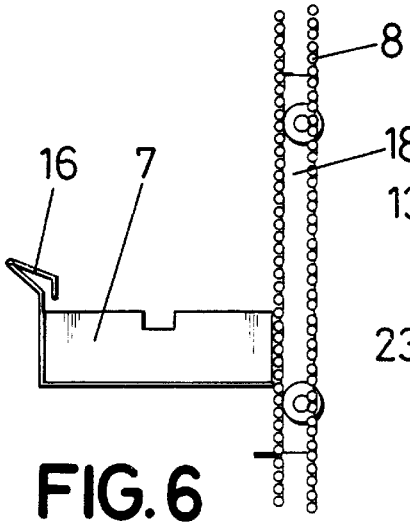
FIG. 6
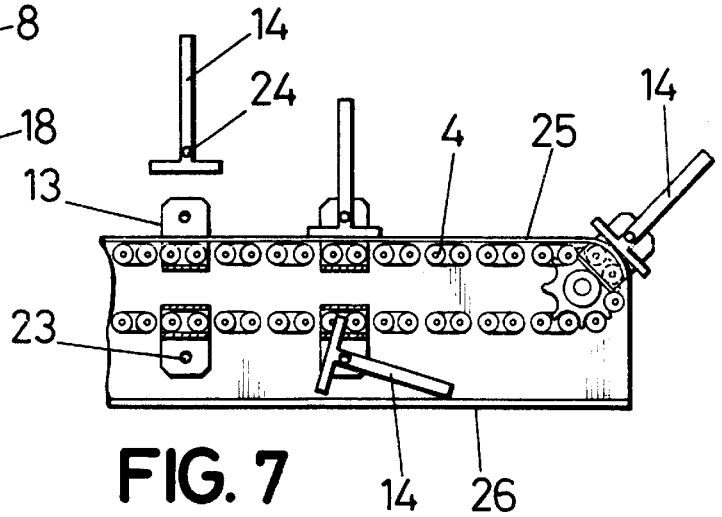
FIG. 7
FIG. 8
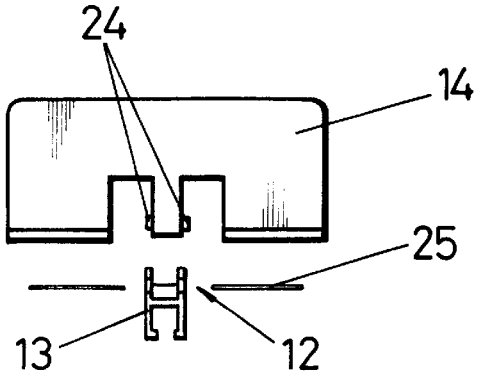

DISTRIBUTOR

OBJECT OF THE INVENTION

As expressed in the title of the present specification, the following invention consists of a vending machine, that is preferably useful to dispense refrigerated food products, for which purpose it has the corresponding refrigerating equipment, in such a way that the object of the vending machine is to permit the removal of the products without them being knocked, and to have a large variety of products.

In this way, the selected product is conveyed towards the mouth of the withdrawal box, without being knocked, thus preventing possible breakage, and in the event that the selected food product requires a spoon in order to be eaten, the user has access to a box of the machine itself in order to take out the corresponding spoon.

On the other hand, the vending machine can include an insulating plate in order to define inside it two compartments that may be kept at different temperatures, making it possible to have products that should be kept at a low temperature (for example 4° C.) and other products that are kept practically at room temperature (for example 15° C.).

Hence, a large variety of products may be placed in the vending machine, it being possible to keep them at the temperature suited to each one of them for their perfect preservation.

Likewise, the product dispensing mechanism, defined by means of the corresponding conveyor belt or chain provided with the respective elements for conveying the products, positioned equidistant in accordance with the size of the products, may be materialized in such a way that the same is very simple upon being based on an endless plastic conveyor chain, obtained by molding, geared between a pair of pinions and whose outside surface has a series of projections very close to each other, provided with some through holes.

FIELD OF APPLICATION

The vending machine of refrigerated food products is especially applicable for installation in schools, hospitals, public institutions, companies, etc. allowing users to select a large variety of desserts, custard, yogurt, egg custard, dairy products or the like and snacks, as well as other products that should not be kept at a low temperature for their suitable preservation, such as nuts, candy, cookies, etc. wherein refrigeration can even spoil the product.

BACKGROUND OF THE INVENTION

Vending machines that include refrigerating equipment, are used to dispense cold drinks or food products which due to their ingredients need to be kept at a low temperature until they are consumed, in such a way that the mechanisms necessary for the removal of the selected products vary in different cases, as a logical consequence of the products that should be handled.

Hence, we can consider those vending machines of refrigerated food products that have some bodies rotating between two shafts, a top one and a bottom one, which are provided with some blades which as compartments house the products to be dispensed.

The main inconvenience that such vending machines have, is that the number of products to be selected is very small, for example six, and besides the distance between the blades that define the compartments is fixed and therefore, depending on the product that is to be selected, it may happen that due to its own volume there is a lot of wasted space.

The fact that the distance between the blades of the bodies where the products are deposited is fixed, is due to the fact that the owner of the vending machine is the one who decides what products are to be placed for their selection, therefore, the manufacture should manufacture it with some fixed dimensions.

On the other hand, given that the bodies for placement of the food products to be dispensed rotate between two shafts arranged vertically, the position of the products in the front and rear part thereof, is reversed, consequently the products overturn, and in the dispensing thereof they fall towards the withdrawal box, a fall that may spoil them.

Besides, in vending machines of refrigerated products that dispense products that normally require spoons for their consumption, there is the inconvenience that since the machines do not have a specific space to house the spoons, the only alternative is to place a container on the top of the machine or close to it, a container that contains the spoons so that the user who needs it may take one, but the container may accidentally fall over or a unscrupulous person may take all the spoons or intentionally knock the container over.

DESCRIPTION OF THE INVENTION

The present specification presents a vending machine of the type of vending machines that include refrigerating equipment, keeping the food products refrigerated for their preservation until they are dispensed for their consumption, the vending machine being comprised of a series of rectangular plan trays in horizontal position, pivotable independently from each other, with regard to a shaft relative to a front vertex, some longitudinal compartments being defined in the cited trays, compartments centrally having a longitudinal opening with regard to which corresponding chains rotatable between two horizontal shafts are provided, chains that operated by the corresponding motor move the selected products towards a receiving tray for conveyance towards the mouth for withdrawal by the user.

The product receiving tray is arranged in a transversal position with regard to the advancing of the products through the compartments and close to the open side for the discharge of the products.

The receiving tray on which the selected products are deposited, have a length similar to the width of all of the compartments of the deposit trays, the receiving tray being moved vertically by a slide guided and conveyed by a chain or belt positioned between two vertically aligned shafts.

The compartmentalized trays are pivotable with respect to a shaft relative to one of their front vertexes, collapsing towards the outside of the body of the machine for its loading, the machine having a platform removable towards the outside so that the operator who loads the machine has access to it permitting easy loading of the highest trays.

The compartments into which the product depositing trays are divided, have in their base a central opening, in relation to which the endless chain or belt is arranged between two horizontally aligned shafts, a series of bodies being connected equidistantly in said endless chain, bodies to which transversal plates are connected pivotably, plates that push the products in the advance of the chain operated by the corresponding motor that transmits the movement to one of the gearing shafts.

The bodies fixed to the respective chains or belts of the compartments can be positioned in accordance with the size of the product that they house, permitting a simple adaptability to the size thereof.

On the other hand, the movement of the corresponding belt or chain of the compartments of the product depositing trays by means of the respective operating motor, is defined by a micro that the expelled products receiving tray includes, giving an order for the motor to stop when the product contacts the cited micro.

The tray for receiving and unitary conveying of the selected products towards the mouth for withdrawal by the user is integral to a slide guided and slidable vertically by a chain between two vertically aligned shafts, the base of the receiving tray having centrally and longitudinally an opening in relation to which it has an endless chain rotating between two shafts, the chain being operated by the corresponding motor which transmits movement to one of the gearing shafts.

The rotatable chain of the receiving trays of the products expelled from the corresponding deposit compartment, has a pair of strips that thrust the products that bring the product towards the mouth for withdrawal by the user, and which are in an equidistant position to each other.

Besides, the tray for receiving and conveying the selected products towards the withdrawal mouth in relation to the longitudinal side close to the open ends of discharge of the products from the compartments of the different deposit trays of the products to be selected, has a micro that sends stopping orders to the corresponding operating motors of the chains of the compartments of the trays, and at the same time it gives a collecting order to the electronic control system of the machine.

The mouth for withdrawal of the products by the users is located in correspondence with the middle part of the product depositing trays, the mouth for access to the spoon box being under it, a box which is operable, only, when the selected product requires the use of a spoon for its consumption.

Hence, it is a question that the path of the slide carrying the product receiving tray from the deposit and conveying compartments to the withdrawal mouth is the smallest possible.

Likewise, the vending machine can include an insulating plate that defines two inside compartments that are kept at different temperatures, the insulating plate having some dimensions similar to those of the compartmentalized trays where the products are located, the cited compartments being provided with respective chains or belts to which some product conveying strips are connected pivotably, the receiving tray of the products expelled from the corresponding compartments of the product placement trays being in the inoperative position with respect to the insulating plate, collaborating in this way in the insulation of the two inside compartments with the insulating plate in order to keep them at different temperatures.

The chains of each one of the compartments of the product placement trays, geared between respective pinions, have on their outside surface some small projections, very close to each another, provided with a through hole, through which some product conveying strips are connected pivotably in the dispensing operation towards the tray for receiving and conveying to the withdrawal box.

The product conveying strips that are connected pivotably to the advance chains or belts, have a generally rectangular shape, with a central recess with a length similar to the width of the chain or belt itself, said recess being in relation to its side of abutment to the base of the compartment and said strips being provided in relation to the end of the lateral sides of the cited recess with respective stubs for pivoting connection to the corresponding hole of the respective projection of the belt, in such a way that in the advance of the belt the strips convey the products sitting centrally on the open base of the compartment.

On the other hand, the conveying strips, once the product has been dispensed, can pivot freely, with respect to the pair of stubs of pivoting connection to the belt, as their free end abuts against a bottom platform for the purpose of taking up less space and in order to be able to increase the capacity of the machine, given that the base of the compartment extends in relation to the top part of the belt.

In order to complete the description that is going to be made hereinafter and for the purpose of providing a better understanding of the characteristics of the invention, the present specification is accompanied by a set of drawings, in whose figures the most characteristic details of the invention are represented in an illustrative and non-restrictive manner.

BRIEF DESCRIPTION OF THE DRAWINGS

FIG. 5 shows a front view of the slide guided and conveyed by a chain or belt, to which the tray for receiving the products for their conveyance to the access mouth for their withdrawal by the user is fastened, it being possible to see the chain or belt provided with a pair of strips that push the product, towards the side close to the receiving mouth.

FIG. 6 shows a side raised view of the slide guided and conveyed by a chain, showing the product receiving tray with a micro in the side that is close to the compartments of the trays in order to detect their expelling.

FIG. 7 shows a detailed view of the arrangement of the trays for conveying the products on the chain or belt, showing a vertical conveying plate in its top movement when its base sits on the base of the corresponding compartment.

FIG. 8 shows a front view of the product conveying strip or plate and the pivotable connection piece that is fastened to the chain, it being possible to see the pivots of the conveying plate that fit in respective holes of the piece fastened to the chain by simple pressure.

DESCRIPTION OF A PREFERRED EMBODIMENT

Figure 1:
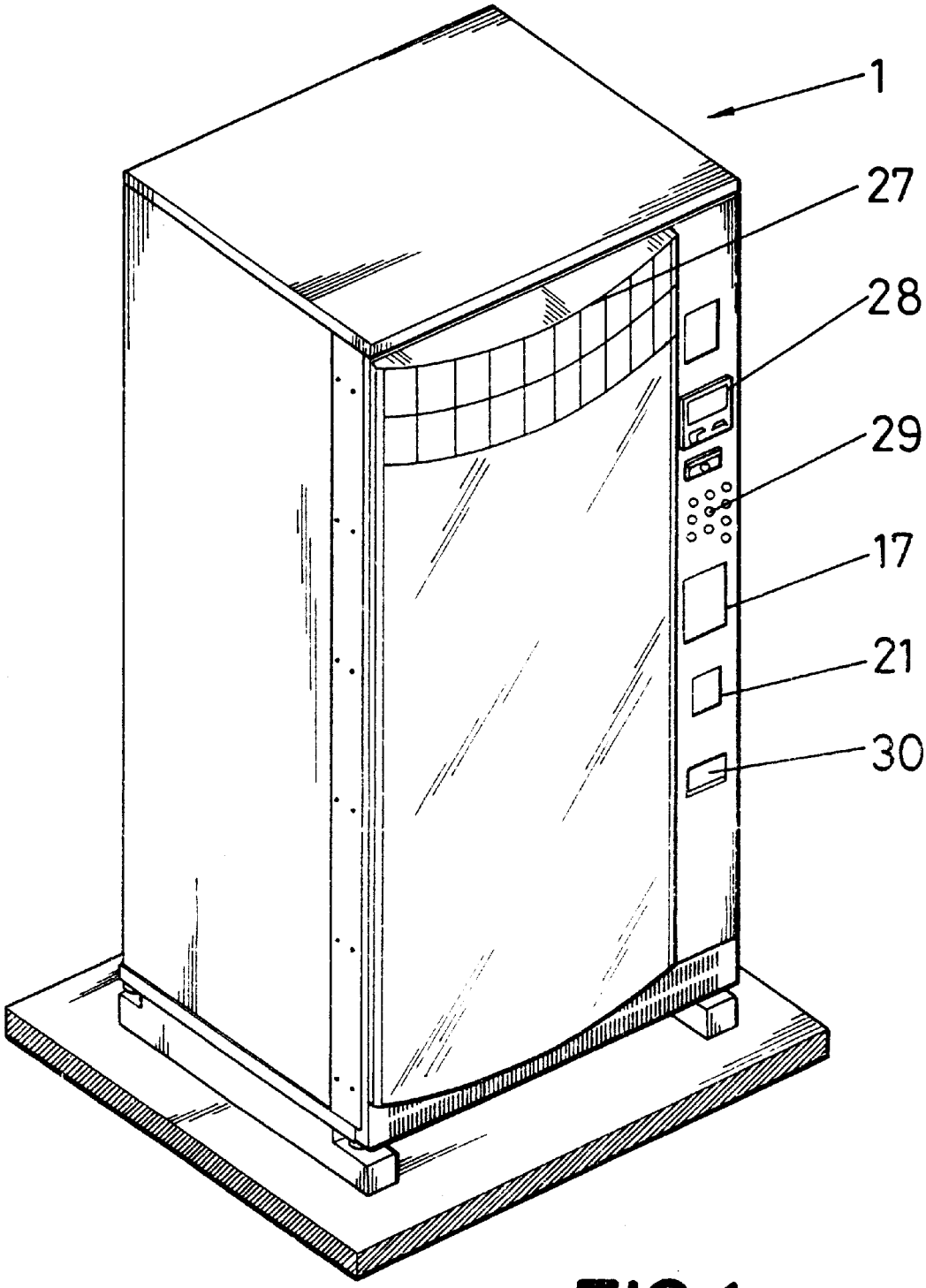
FIG. 1 shows a perspective view of the vending machine, showing the mouth of the box for withdrawal of the product selected by the user, as well as the mouth of restricted access to the box where the spoons are located.
Figure 2:
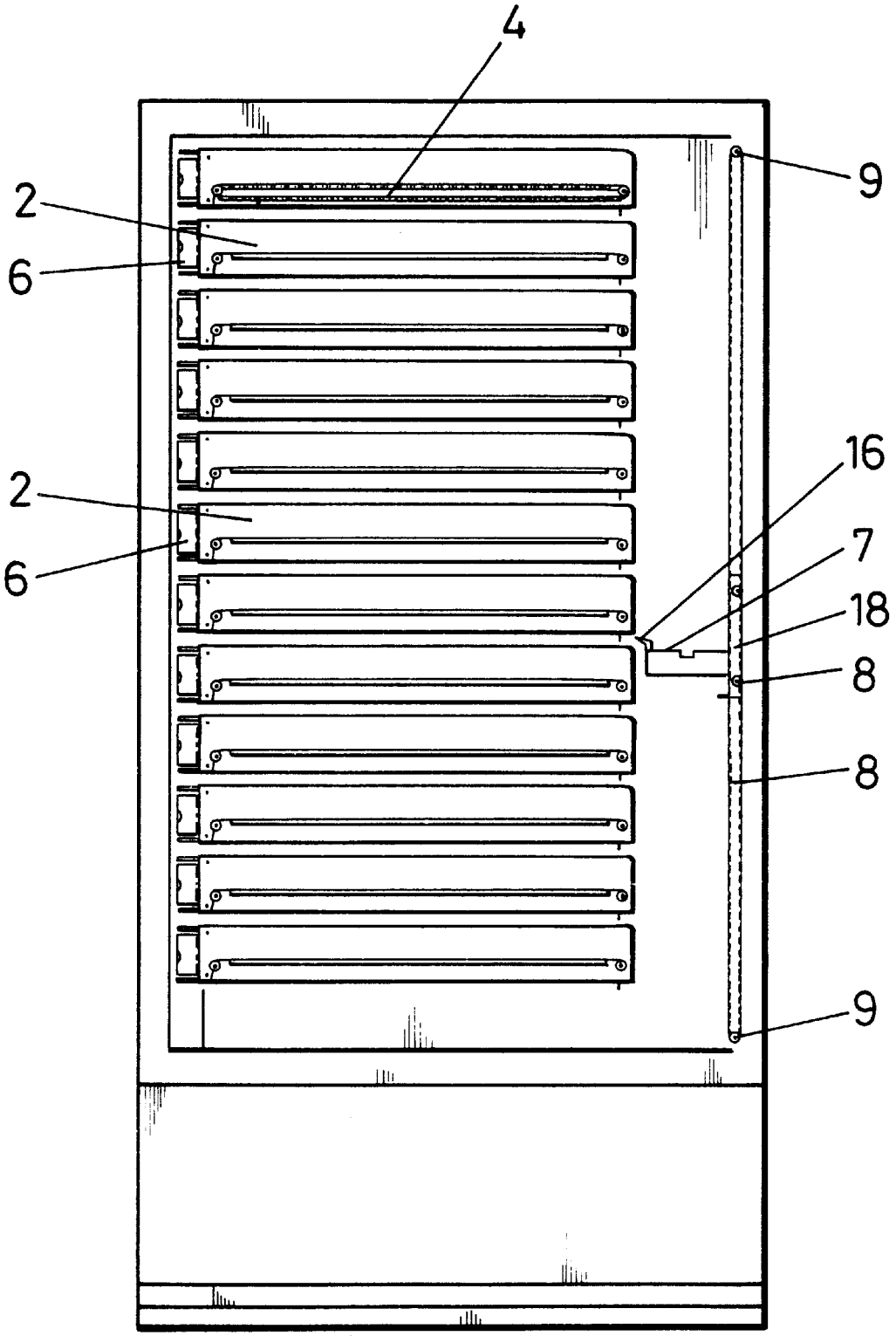
FIG. 2 shows a front view of the inside of the machine showing the trays where the products are deposited, as well as the tray for receiving the selected product integral to the slide guided and conveyed by the corresponding chain or belt arranged between a pair of vertically aligned shafts.

In view of the commented figures and in accordance with the adopted numbering, we can see how the vending machine (1), has a generally prismatic rectangular shape, the vending machine being used to dispense refrigerated products for which purpose it has the corresponding refrigerating equipment, having in its front a display (27) of the products to be selected, as well as the different elements such the coin slot (28), the product selection pushbuttons (29), the mouth (17) for withdrawal of the selected products, the mouth (21) accessible when the selected product requires a spoon for its consumption and the change box (30).

The vending machine (1) that includes the corresponding refrigerating equipment has a series of trays (2) in which different compartments (3) are defined, the base of the cited compartments having in the center an opening (12) under which there is a chain or belt (4) geared between corresponding horizontally aligned shafts (5), a motor (6) transmitting rotating movement to one of the shafts (5) in order to cause the advance of the chain or belt (4).

The chains or belts (4) include some bodies (13) equidistant from each other, to which respective product conveying plates or strips (14) are connected pivotably, in such a way that the bodies (13) can be fastened in accordance with the product to be dispensed, and the pivotation of the plate (14) with respect to the pivotable connection bodies (13) permit that the plates in the top part of the compartment are in vertical position, conveying the products, while in the bottom part they are collapsed occupying a smaller space.

In this way, the generally H-shaped bodies (13) are fastened to the chain (4) at one of their ends, and at the other end they have some holes (23) in which the respective pivots (24) of the product conveying plate (14) fit, in such a way that the conveying plate (14) remains in vertical position on the base (25) of the compartment (3), while when the front end for expelling of the product is reached, the body (14) no longer contacts the base (25) and pivots with respect to the pivot or shaft (24) collapsing when abutting against the bottom (26) of the tray, occupying a minimum amount of space.

Figure 3:
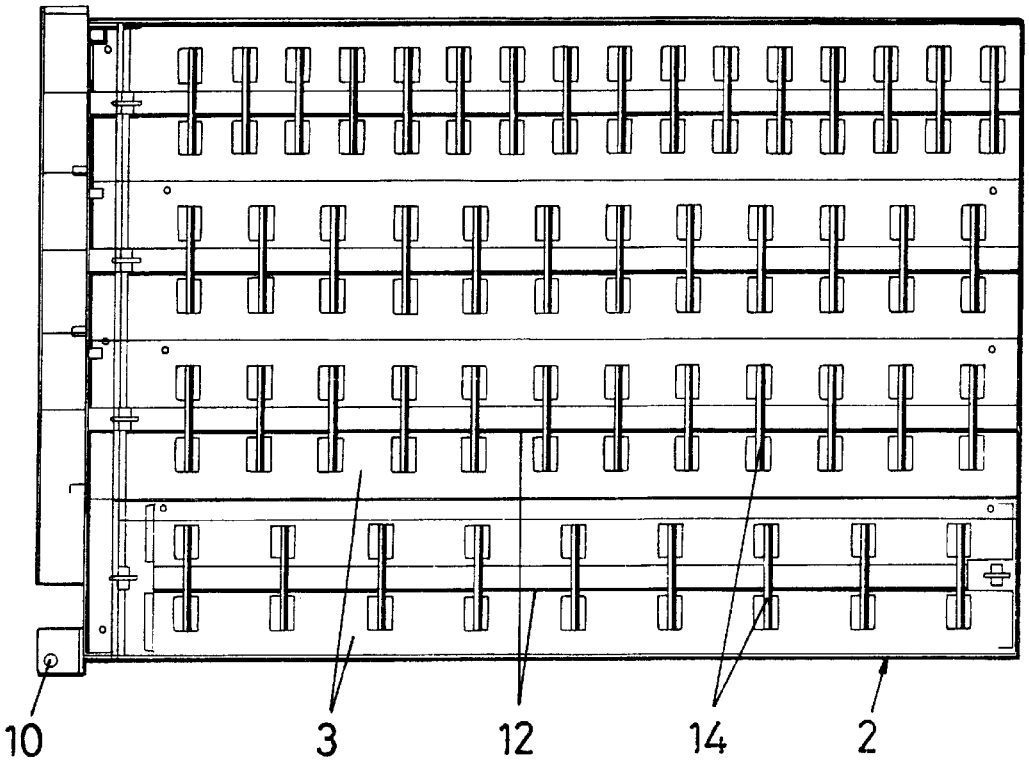
FIG. 3 shows a plan view of a tray where the products are deposited in the different compartments defined therein, it being possible to see how the strips for conveying the products can be distanced equidistantly at different distances in accordance with the product to be contained.
Figure 4:
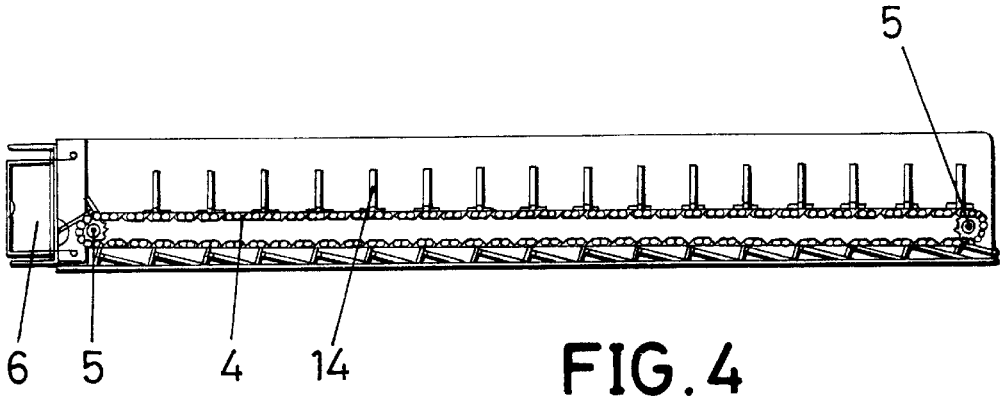
FIG. 4 shows a raised view of a compartment of a tray where the products are deposited, it being possible to see the chain or belt which in its top part has the strips for conveying the products in vertical position, and in its bottom part the strips pivoted with respect to the body integral to the chain, occupying a smaller space.
Figure 9:
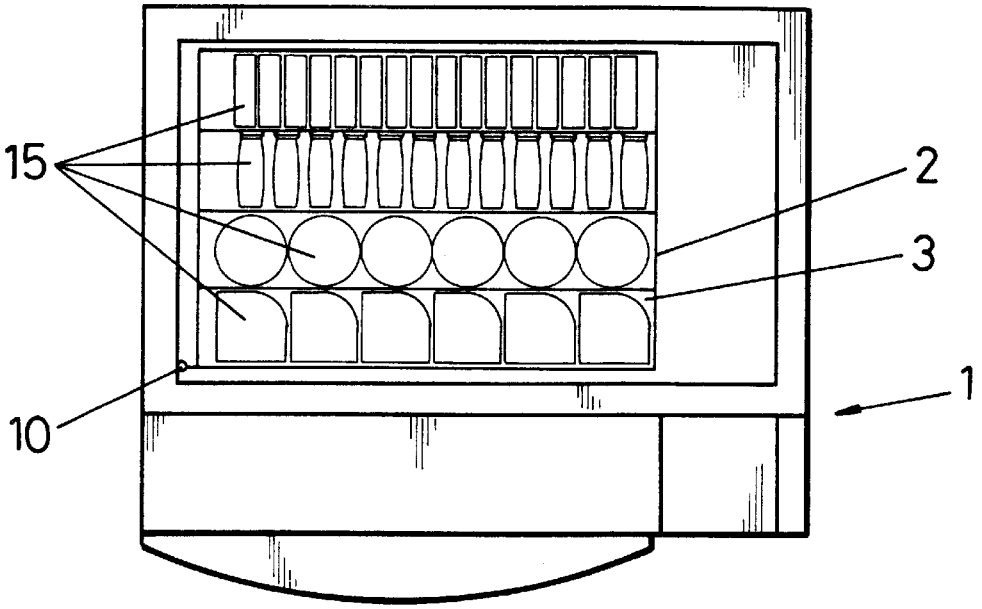
FIG. 9 shows a schematic view of a product depositing tray, with the different compartments thereof, showing how the products may have different shapes and sizes.
Figure 10:
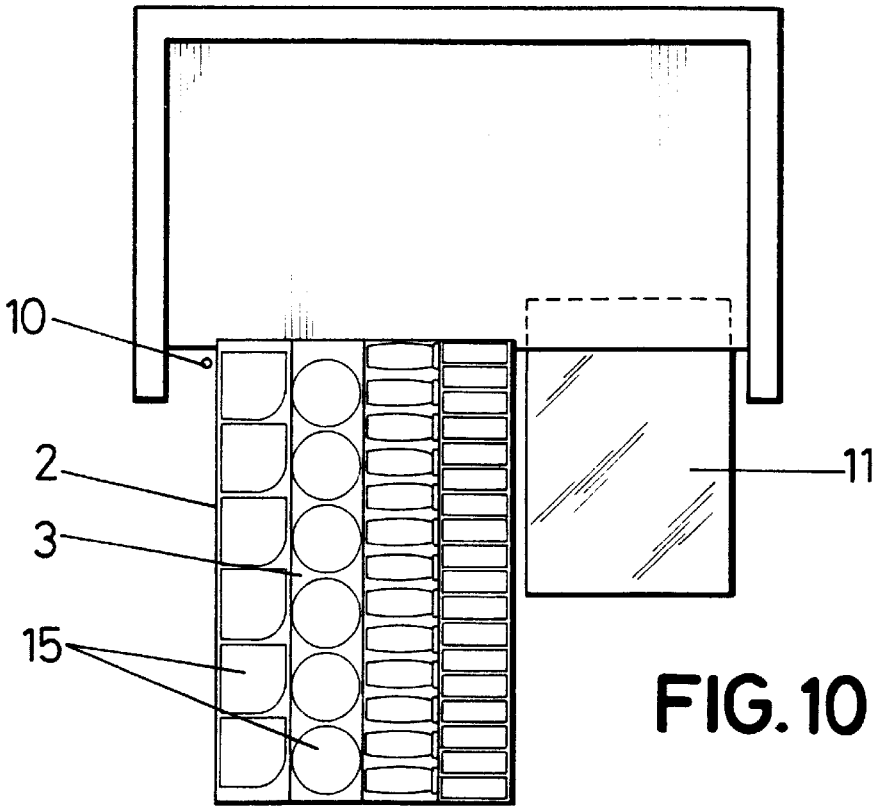
FIG. 10 shows a schematic view of the product depositing tray, that is collapsed towards the outside upon having pivoted with respect to a shaft relative to one of its front vertexes.
Figure 11:
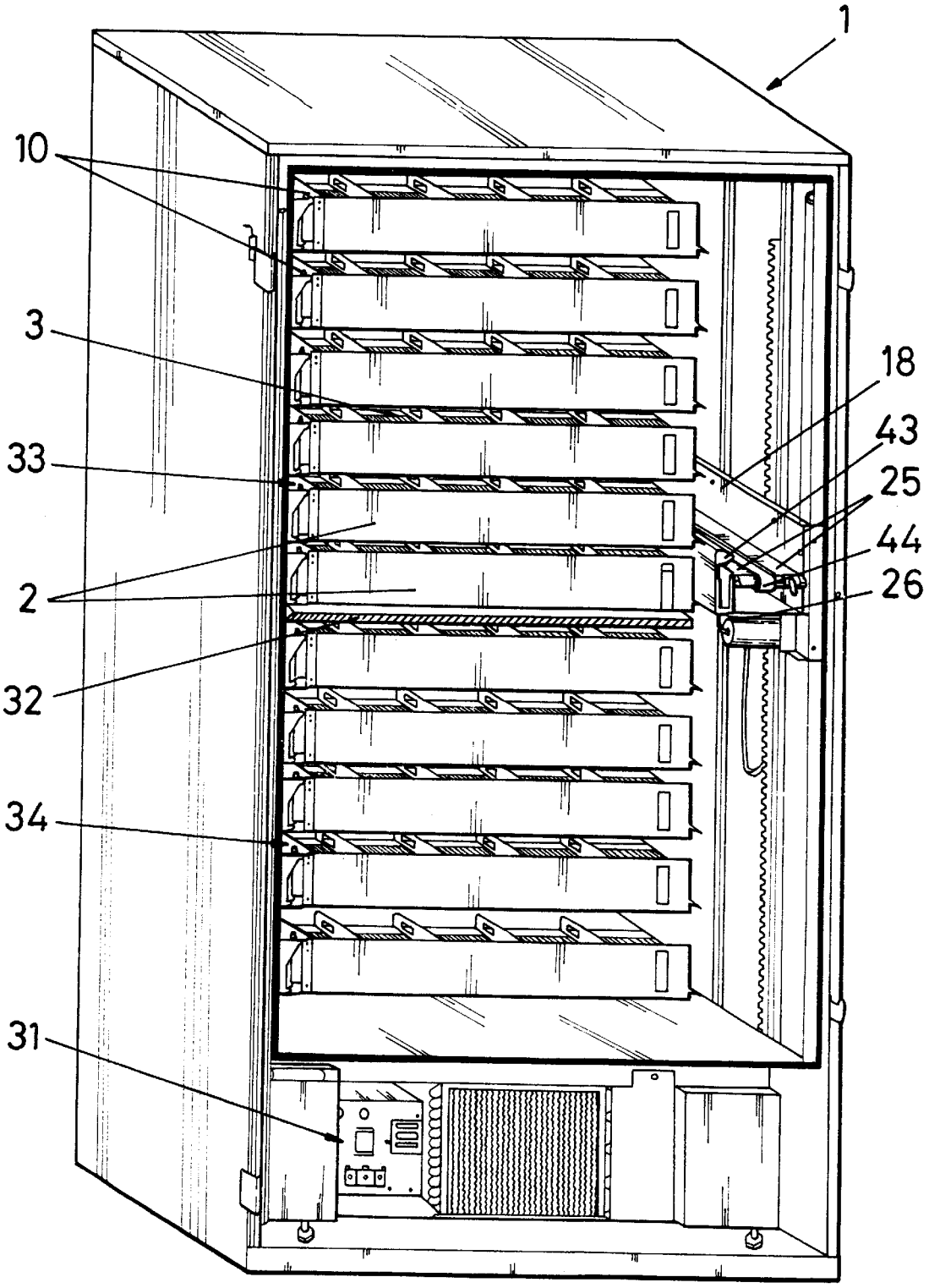
FIG. 11 shows a perspective view of the vending machine, without the door, showing the two compartments that are defined by a separating insulating plate, as well as the slide carrying the tray for receiving and conveying the expelled products, from the corresponding trays to the withdrawal box, as said slide is vertically guided.
Figure 12:
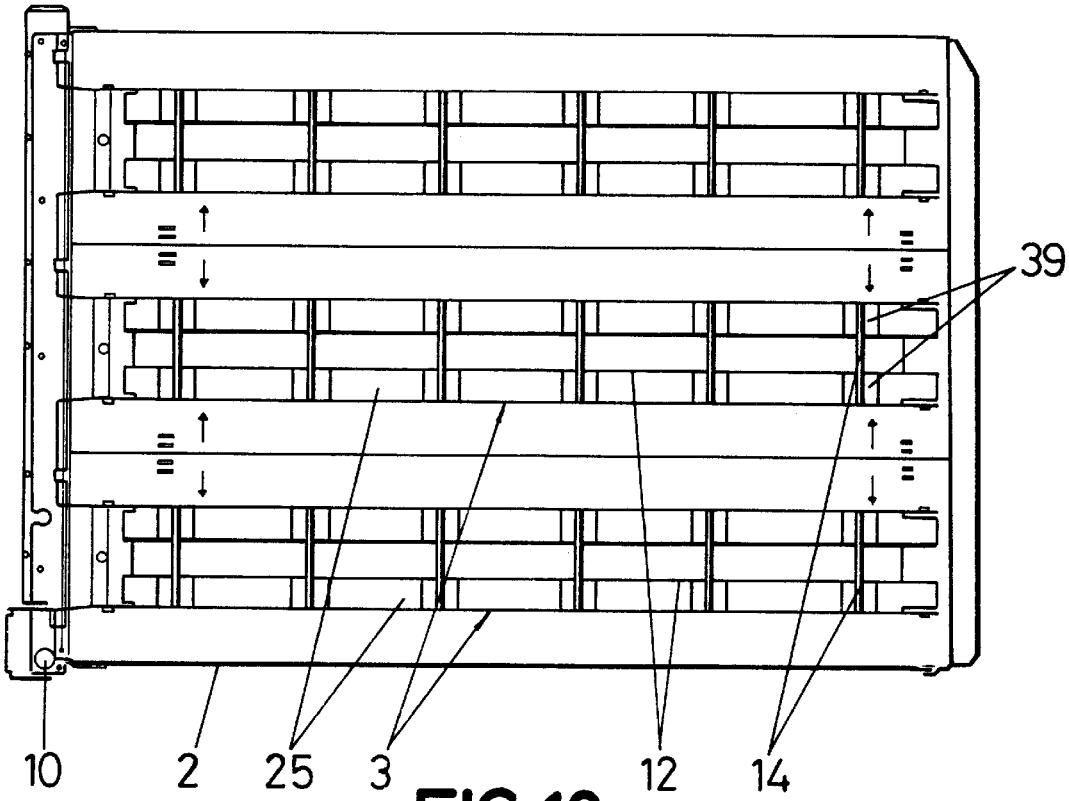
FIG. 12 shows a plan view of the tray divided into the corresponding compartments, showing how in the base of the compartments a longitudinal center opening is defined, in relation to which the chain or belt carrying the strips conveying the products deposited thereon is moved.
Figure 13:
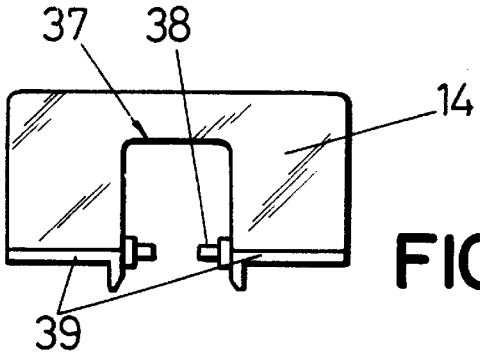
FIG. 13 shows a front view of a product conveying strip, showing how it has a center recess with a length similar to the width of the chain, in whose side sides of the recess it has respective stubs, through which it connects pivotably to the belt of the corresponding compartment.
Figure 14:
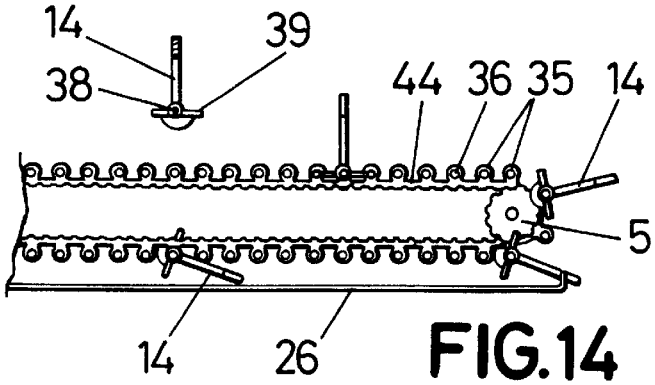
FIG. 14 shows a detailed view of the side section of gearing of the belt carrying the product conveying strips, showing how in the rotation thereof from the top part to the bottom part, said strips collapse when they abut against a bottom platform, occupying a smaller space and permitting a larger capacity of the machine.
Figure 15:
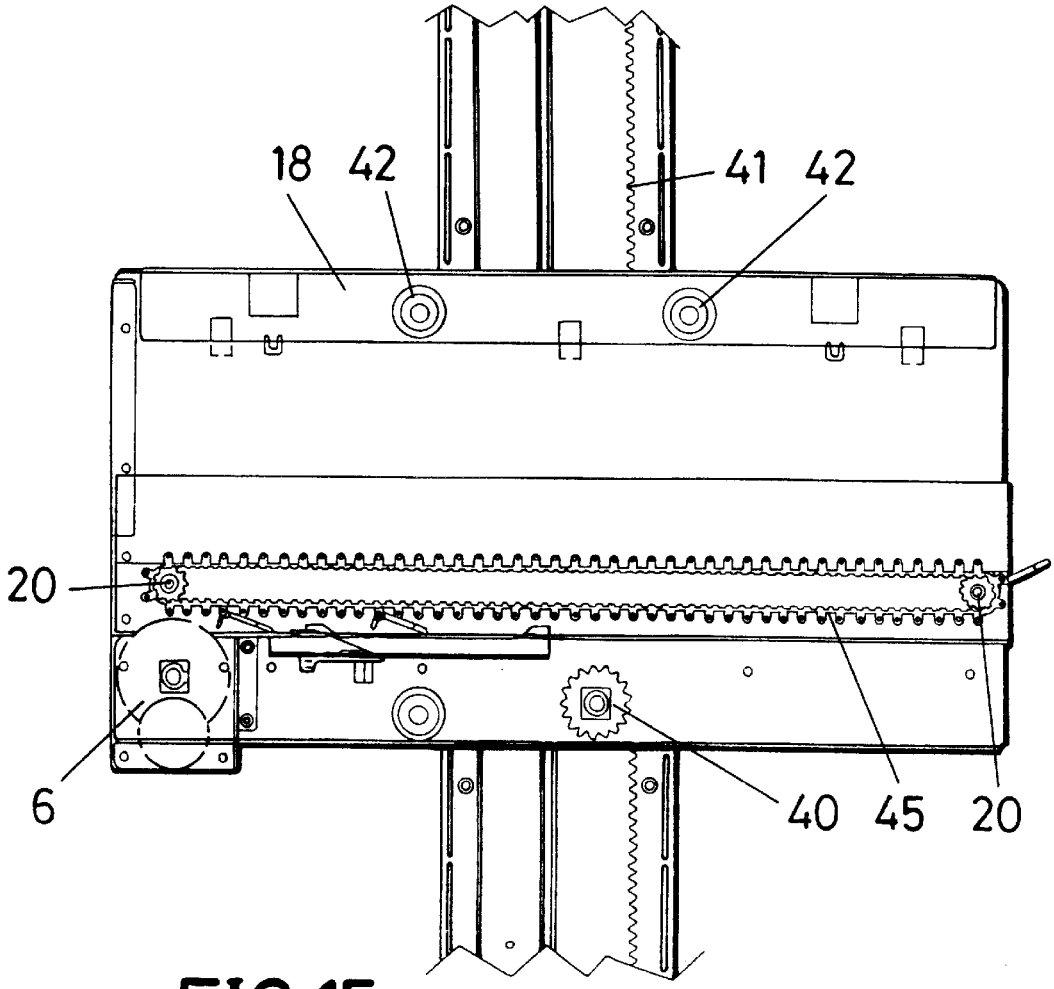
FIG. 15 shows a front view of the slide carrying the tray receiving the products expelled from the different compartments of the trays for placement thereof, showing how the cited tray has a belt similar to the one of the compartments of the different trays for placement of the products, for the purpose of moving the same towards a withdrawal box.
Figure 16:
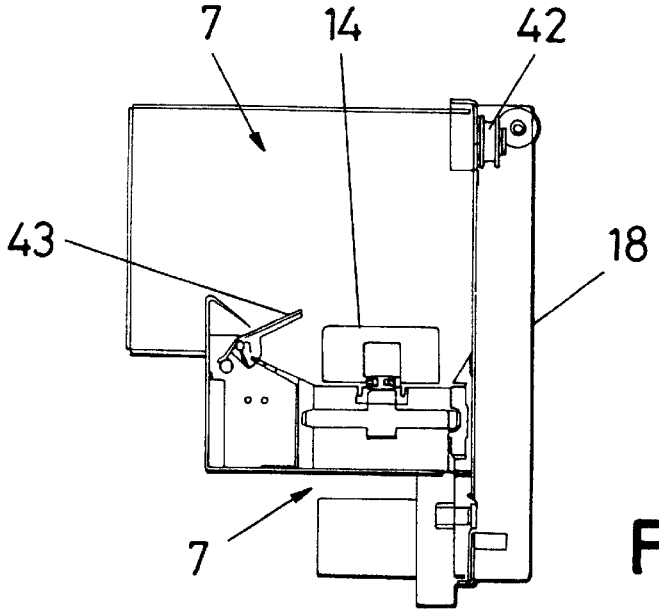
FIG. 16 shows a raised view of the slide for receiving the products from the different compartments of the trays, showing the strip on which all the products abut in their expelling, causing the pivotation thereof and that the same acts on a micro or photocell, that will communicate said expelling to the control system in order to materialize the collection.

FIG. 3 of the drawings shows how in the compartments (3) of the tray (2), the plates (14) of individual conveyance of the products contained in them, can be positioned at a different distance adapting to the size of the product to be contained, with the big advantage of totally taking advantage of the space.

The base of the compartments (3) has an opening (12), through which the bodies (13) fastened to the chain or belt (4) slightly project, and to which the product conveying plates (14) connect pivotably, plates which have a flat base that slides on the base (25) of the compartment, the plate remaining in a vertical position, expelling the products (15) in the advance of the chain through one of the open sides of the compartment (3).

On the other hand, the vending machine (1) includes a tray (7) receiving and conveying the selected products towards the box (17) for withdrawal by the user, for which purpose the cited tray (7) is integral to a slide (18) movable along the open side of the trays (2) upon being guided and conveyed by a chain or belt (8) assembled between a pair of vertically aligned shafts (9).

The tray (7) receiving the selected products from the corresponding compartment (3) of the respective tray (2) has a configuration similar to that of the compartments (3), since its base is open in the center and in relation to said opening it has a chain or belt (19) geared between a pair of shafts (20), aligned horizontally and likewise it has a pair of bodies (13) connected to the chain (19) in equidistant position with their corresponding product conveying plates (14), said chain being operated by the motor (6) that transmits rotating movement to the corresponding shaft (20).

In this way, when the user selects the desired product by means of the pushbuttons (29), the corresponding motor (6) is activated conveying the chain (4), so that the selected product pushed by the plate (14) falls on the tray (7) arranged in relation to the tray (2) relative to the selected product, the product (15) activating the micro (16) which gives the stopping order to the motor (6), as well as the collecting order to the control system of the machine.

The tray (7) for receiving the selected products, is at the ideal height by means of some photocells, and the product contained in said tray (7) is moved towards the side close to the withdrawal mouth (17) by the plates (14) arranged in the chain (19).

In this way, the variety of products that can be offered is very large, since if the machine, with some normal measurements has twelve trays and each one of them has four compartments, 48 different products can be offered, although since some products are demanded more than others, the amount thereof can be adapted to the needs.

Besides, given that the pieces (13) can be placed in the desired place in a simple and rapid manner, adaptation to the dimensions of the products can be done easily when some of the products are to be changed.

On the other hand, given that some products (15) require the use of a spoon for their consumption, when any of said products is chosen, the mouth (21) will be accessible so that the user may take a spoon, thus preventing that all the spoons are deposited in a container that can overturn or from which the spoons can be easily removed.

For the purpose of making it easier to load the uppermost trays (2), the machine itself (1) has a retractable platform (11) that can be drawn out in order to stand on it and load the machine once the tray (2) to be filled has pivoted outside the body of the machine with respect to the pivotation shaft (10).

Likewise, the vending machine (1) that includes refrigerating equipment (31) can have an insulating plate (32) that defines inside two compartments (33) and (34) kept at different temperatures, there being in each one of the compartments (33) and (34) the trays (2) divided into some compartments (3), in such a way that the products to be dispensed, will be deposited in the different compartments (3) independent from each other, in such a way that in a single compartment identical products will inevitably be placed, but the different compartments (3) defined in the trays (2) may include different products.

Thus, the compartments (3) of the trays (2) have their base (25) with an opening (12) in their center part, in relation to which a belt (44) remains, a belt which is geared between a pair of pinions (5), in such a way that the belt (44) has its outside surface provided with some small projections (35), very close to each other, provided with a through hole (36), through which a series of strips (14) connect pivotably, strips positionable in accordance with the size of the product to be contained.

The strips (14) have a generally rectangular shape, and in relation to the side of abutment to the base (25) of the corresponding compartment, they have a recess (37) with a length similar to that of the width of the belt (44), having in relation to the end of their inside sides respective stubs (38) that fit in the sides of the holes (36) of the projections (35) of the belt (44), materializing the pivotable connection to the belts (44).

Likewise, the strips (14) in relation to the area of overlapping the base (25) have some small orthogonal flanges (39), that upon sitting on the base (25), allow them to be kept in a vertical position during the advance of the belt, for the dispensing of the products.

With this structure the products remain on the base (25) of the different compartments (3), and the strips (14), connected pivotably to the belts (44), through the stubs (38) that fit in the corresponding holes (36) of the projections (35), convey the products as the small flanges (39) overlap the open base (25), in such a way that in the advance of the belts (44), the strips (14) convey the products, expelling the first product towards the receiving tray (7) assembled orthogonally to the advance of the belts (44) in a vertically movable slide (18).

Hence, the slide (18) has a pinion (40) that gears in a toothing (41) of a vertical guide, in such a way that by means of the corresponding motor that activates the pinion (40) the vertical movement of the slide (18) with respect to the guide by the toothing (41) is produced, in order to be positioned at the level of the tray (2) from one of whose compartments (3) the corresponding product is going to be dispensed, the slide then dropping to the bottom part in order to convey the selected and dispensed product to the withdrawal box. The slide (18) is guided in its movement along the toothing (41) by some pulley-wheels (42).

Besides, tray (7) receiving the products dispensed from the corresponding compartments (3) of the trays (2) where the products to be dispensed are located, in its inoperative position is always positioned with regard to the same height of the insulating plate (32), collaborating in this way with the insulating plate, in the insulating of the two inside compartments (33) and (34), so that they are kept at different temperatures.

Normally, the insulating plate (32) is arranged, approximately in the middle part of the vending machine, permitting access to all of the trays in the least possible amount of time.

Likewise, the belt (45) relative to the tray (7) for receiving and conveying the dispensed products towards the withdrawal box, is geared between a pair of pinions (20) producing its movement by the motor (6) that activates one of the pinions (20) when the movement of the product towards the bottom withdrawal box is produced.

When a product is dispensed from the corresponding compartment (3) towards the receiving tray (7), the product abuts against a strip (43), causing its pivotation and that upon activating a photocell or micro gives the order of the dispensing produced in order to carry out the collection, the product being conveyed towards the withdrawal box and expelled with the advance of the belt (45).

On the other hand, the trays (2) are pivotable with respect to a shaft (10) in order to allow their removal to the outside when loading takes place.

Besides in order to be able to have the maximum capacity possible in the machine, the strips (14) when they pivot when expelling a product towards the bottom part, collapse when their free end abuts against a lower platform (26), with regard to the bottom itself of the trays, and as the flanges (42) abutted against the top base (25) become free, flanges that are interrupted at both ends on the gearing pinions of the belts, the strips (14) being able to pivot freely, since they have a central recess.

Given that there are two compartments (33) and (34) kept at different temperatures in the vending machine, products that should be kept at a low temperature (approximately 4° C.) until they are consumed and products that are kept at room temperature (approximately 15° C.) may be deposited in the vending machine, with the added advantage that given the minimum amount of space occupied by the dispensing mechanism of the products deposited on the trays, it is possible to have a large number of different products.

What is claimed is:

1. A vending machine which comprises a first plan tray in a substantially horizontal position, the first plan tray being pivotable independently with respect to a shaft arranged on a front vertex of the machine, and the first plan tray has at least one substantially longitudinal compartment, said at least one longitudinal compartment having a base with a longitudinal opening in a center, wherein a first conveying means comprising at least one of chains and belts is moved by two horizontal shafts, said horizontal shafts being activated by a first motor, said first conveying means including a series of projections having holes in which a separating means comprising at least one of plates and strips is connected pivotally to move a selected product towards a second tray for receiving and conveying said product towards a mouth for withdrawal by a user, said second tray being in a transversal position with regard to the advancement of the selected product which is expelled from said at least one longitudinal compartment of the first plan tray, and said second tray on which the selected product is deposited has a length similar to a width of said at least one longitudinal compartment of the first plan tray, said second tray being moved vertically by a slide guided and conveyed by a second conveying means comprising at least one of chains and belts positioned between two vertically aligned shafts, the vending machine further includes an insulating plate that defines two compartments kept at different temperatures, said insulating plate having dimensions approximate to the first plan tray.

2. A vending machine, according to claim 1, wherein the first plan tray collapses toward an outside of the body of the machine for the loading thereof, the machine having a platform drawable outwardly in order to have access to the platform during loading.

3. A vending machine, according to claim 1, wherein said first conveying means is arranged between the two horizontal shafts, said projections of said first conveying means comprising a series of bodies connected equidistantly, bodies to which a respective separating means selected from plates or strips are connected pivotally, said separating means pushes the selected product in the advance of the first conveying means operated by the first motor that transmits movement to one of the two horizontal shafts.

4. A vending machine, according to claim 1, wherein, said projections of said first conveying means comprises a series of bodies positionable according to a size of the selected product, so that each one of the compartments houses bodies to which respective separating means are connected pivotally, said separating means pushes the product in advance of the first conveying means operated by a first motor that transmits movement to one of the shafts.

5. A vending machine, according to claim 1, wherein, said projections of said first conveying means comprises a series of bodies in which a respective separating means selected from plates or strips are connected pivotally, said separating means pushes the selected product in advance of the first conveying means operated by the first motor that transmits movement to one of the two horizontal shafts, and said separating means pushes the selected product during the expulsion of the selected product and remains in a vertical position on the base of said at least one longitudinal compartment that houses the product, and at a bottom part of said first conveying means, said separating means pivots with respect to the bodies fastened to said first conveying means, occupying a smaller space.

6. A vending machine, according to claim 1, wherein a movement of said first conveying means by means of the first motor is defined by a micro-switch that the second tray receiving the expelled product includes, giving a stopping order to the first motor when the selected product contacts a micro-switch in its expelling from said at least one longitudinal compartment.

7. A vending machine, according to claim 1, wherein the second tray for unitary receiving and conveying of the selected products towards a mouth for withdrawal by the user is integral with a slide guided and movable vertically by said second conveying means arranged between the two vertically aligned shafts, the base of said second tray having in the center and longitudinally arranged an opening in relation to which a third conveying means selected from chains and belts geared between two conveying shafts and being operated by a corresponding motor that transmits the movement to one of the conveying shafts.

8. A vending machine, according to claim 1 wherein the second tray for unitary receiving and conveying of the selected products towards a mouth for withdrawal by the user is integral with a slide guided and movable vertically by said second conveying means between the two vertically aligned shafts, the base of said second tray having in the center and longitudinally arranged an opening in relation to which it has a third conveying means selected from chains and belts geared between two conveying shafts and being operated by a second motor that transmits the movement to one of the conveying shafts, said third conveying means having separating means selected from plates and strips that push the selected products, the separating means connected to corresponding pieces integral to the third conveying means, equidistant from each other, that bring the selected product close to the mouth for withdrawal by the user.

9. A vending machine, according to claim 1, wherein the second tray for withdrawing and conveying the selected product towards a receiving mouth, in relation to a longitudinal side for expelling the products from said at least one longitudinal compartment of the first plan tray, has a micro-switch that defines the movement of the first conveying means, which is moved by the first motor by giving a stopping order to the first motor when the selected product contacts said micro-switch in its expelling from the at least one longitudinal compartment, and at the same time that said micro-switch gives the order for collection to the electronic control system of the machine, said second tray for unitary receiving and conveying the selected product towards the mouth for withdrawal by the user is integral to a slide guided and movable vertically third conveying means selected from chains or belts between two vertically aligned shafts, the base of said second tray having in the center and longitudinally an opening in relation to which it has second conveying means selected from chains or belts geared between two shafts and being operated by a second motor that transmits the movement to one of the shafts.

10. A vending machine, according to claim 1, wherein a mouth for withdrawal of the products by the user, is arranged over the middle part of the first plan tray, the mouth providing access to a spoon containing box being underneath, the spoon box being operable only when the selected product requires the use of a spoon for its consumption.

11. A vending machine, according to claim 1, wherein the first conveying means selected from said at least one longitudinal compartment of the first plan tray where the products are placed, has in an outside surface a plurality of small projections in close proximity to each other, and provided with a through hole, through which the product separating means selected connect pivotally.

12. A vending machine, according to claim 1 wherein the first conveying means of said at least one longitudinal compartment of the first plan trays where the products are placed, have in their outside surface a plurality of small projections very close to each other and provided with through holes, through which the product separating means connect pivotally, said separating means has a generally rectangular shape, with a center recess in a side which abuts to the base of the at least one longitudinal compartment, said recess with a length similar to the width of the said first conveying means, and said separating means being provided on both sides of said recess with respective stubs for pivotable connection thereof to the corresponding hole of the respective projection of the first conveying means.

13. A vending machine, according to claim 1, wherein the second tray for receiving the products dispensed from the compartments is integral with a slide that is moved vertically along a guide provided with a toothing in which a pinion of the slide gears, and a corresponding motor transmits movement to said pinion.

14. A vending machine, according to claim 1, wherein the second tray for receiving the dispensed products remains, in its inoperative position, at the same height as the insulating plate.

15. A vending machine, according to claim 1, wherein the first plan tray collapses toward the outside of the body of the machine for the loading thereof, the machine having a platform drawable outwardly in order to have access to the platform during loading.

16. A vending machine, according to claim 1, wherein said at least one longitudinal compartment in which the first plan tray is divided has a base having a center and said first conveying means is arranged between the two horizontal shafts, said projections of said first conveying means includes a series of bodies connected equidistantly, bodies to which a respective separating means selected from plates or strips are connected pivotally, said separating means pushes the selected product in the advance of the first conveying means operated by the first motor that transmits movement to one of the two horizontal shafts.

17. A vending machine, according to claim 1, wherein, said projection of said first conveying means comprising a series of bodies positionable according to a size of the selected product, so that said at least one longitudinal compartment houses bodies to which respective separating means are connected pivotally, said separating means pushes the product in advance of the first conveying means operated by a first motor that transmits movement to one of the shafts.

18. A vending machine, according to claim 1, wherein said projections of said first conveying means comprising a series of bodies in which a respective separating means selected from plates or strips are connected pivotally, said separating means pushes the selected product in advance of the first conveying means operated by the first motor that transmits movement to one of the two horizontal shafts, and said separating means pushes the selected product during the expulsion of the product and remains in vertical position on the base of the compartment that houses the product, and at a bottom part of said first conveying means, said separating means pivots with respect to the bodies fastened to said first conveying means, occupying a smaller space.

19. A vending machine, according to claim 1, wherein the second tray for unitary receiving and conveying of the selected products towards a mouth for withdrawal by the user is integral with a slide guided and movable vertically by said second conveying means arranged between the two vertically aligned shafts, the base of said second tray having in the center and longitudinally an opening in relation to which it has a third conveying means selected from chains or belts geared between two conveying shafts and being operated by a corresponding motor that transmits the movement to one of the conveying shafts.

20. A vending machine which comprises a first plan tray in a substantially horizontal position, the first plan tray being pivotable independently with respect to a shaft arranged on a front vertex of the machine, and the first plan tray having at least one substantially longitudinal compartment, said at least one longitudinal compartment having a base with a longitudinal opening in a center, wherein a first conveying means selected from at least one of chains and belts is moved by two horizontal shafts, said horizontal shafts being activated by a first motor, said first conveying means including a series of projections having holes to which a separating means comprising at least one of plates and strips is connected pivotally to move a selected product towards a second tray for receiving and conveying said product towards a mouth for withdrawal by a user, said second tray being in a transversal position with regard to the advancement of the selected product which is expelled from said at least one longitudinal compartment of the first plan tray, and said second tray on which the selected product is deposited has a length similar to a width of all the compartments of the first plan tray, said second tray being moved vertically by a slide guided and conveyed by a second conveying means selected from at least one of chains and belts being positioned between the two vertically aligned shafts.

* * * * *